US008800776B2

(12) United States Patent
Linnhoff

(10) Patent No.: US 8,800,776 B2
(45) Date of Patent: Aug. 12, 2014

(54) MULTI-DECK AIR JIGGING MACHINE

(75) Inventor: Hans-Josef Linnhoff, Haltern am See (DE)

(73) Assignee: Allmineral Aufbereitungstechnik GmbH & Co. KG, Duisburg (DE)

( * ) Notice: Subject to any disclaimer, the term of this patent is extended or adjusted under 35 U.S.C. 154(b) by 137 days.

(21) Appl. No.: 13/641,462

(22) PCT Filed: Apr. 14, 2011

(86) PCT No.: PCT/EP2011/001898

§ 371 (c)(1),
(2), (4) Date: Oct. 15, 2012

(87) PCT Pub. No.: WO2011/147504

PCT Pub. Date: Jan. 12, 2011

(65) Prior Publication Data

US 2013/0032513 A1 Feb. 7, 2013

(30) Foreign Application Priority Data

Apr. 15, 2010 (DE) ..... 10 2010 015 232

(51) Int. Cl.
*B07B 9/00* (2006.01)

(52) U.S. Cl.
USPC ..... 209/21; 209/20; 209/467; 209/471; 209/488; 209/490

(58) Field of Classification Search
USPC ..... 209/20, 21, 467, 488, 490
See application file for complete search history.

(56) References Cited

U.S. PATENT DOCUMENTS

| | | | | |
|---|---|---|---|---|
| 2,429,343 | A * | 10/1947 | Carter et al. | 209/21 |
| 5,087,351 | A * | 2/1992 | Valentine, Sr. | 209/20 |
| 6,907,996 | B1 * | 6/2005 | Fraas | 209/435 |
| 7,708,145 | B2 * | 5/2010 | Li et al. | 209/471 |
| 2006/0254959 | A1 * | 11/2006 | Breuer | 209/21 |

FOREIGN PATENT DOCUMENTS

| | | |
|---|---|---|
| CN | 2889496 | 4/2007 |
| EP | 0318054 | 5/1989 |

* cited by examiner

*Primary Examiner* — Terrell Matthews
(74) *Attorney, Agent, or Firm* — Jennifer S. Stachniak; Robert W. Becker

(57) ABSTRACT

An air jigging machine for dry processing of raw materials, an air supply conduit for supplying working air to an air funnel, and having a pulsing valve. At least two jigging-material carriers for receiving material from a material-feeding mechanism are configured to consecutively receive therethrough working air from the air funnel and to separate the material into heavy and light material layers. The jigging-material carriers are disposed one above the other and are spaced apart. A wall encloses this intermediate space. At least one bypass airline branches off from the air supply conduit downstream of the pulsing valve, bypasses the lower jigging-material carrier, and communicates with the intermediate space for supplying an additional working airflow thereto. Respective discharge devices are provided for the jigging-material carriers for the material layered thereon during a jigging process.

16 Claims, 3 Drawing Sheets

MULTI-DECK AIR JIGGING MACHINE

The instant application should be granted the priority dates of Jul. 24, 2009, the filing date of the corresponding German patent application 10 2009 034 689.9, as well as Jul. 20, 2010, the filing date of the International patent application PCT/EP2010/004417.

BACKGROUND OF THE INVENTION

The present invention relates to an air jigging machine for the dry separation or processing of raw materials, especially coal, and includes a material-feeding mechanism, at least one jigging-material carrier that is provided with openings, as well as a discharge device for the heavy material and the light material that are layered upon the jigging-material carrier during the separating process, whereby for the loosening up or aerating, and for the layering, of the material supplied to the jigging-material carrier into a heavy material layer, which acts as a jig bed, and a light material layer disposed thereupon, an air flow, as working air, supplied from an air funnel disposed below the jigging-material carrier, flows through the jigging-material carrier; the air flow is composed of a partial stream that constantly flows through the jigging-material carrier, and a pulsating partial stream that is superimposed thereon.

An air jigging machine having the aforementioned features is described, for example, in DE 20 2005 007 472 U1. The material that is to be processed is supplied via a material-feeding device to the single jigging-material carrier, which is embodied, for example, as a perforated plate, or is comprised of a wire mesh. By means of an air funnel disposed below the jigging-material carrier an air stream is supplied that is comprised of a partial stream that flows constantly through the jigging-material carrier, and a pulsating partial stream that is superimposed on the constant partial stream. As a consequence of the supply of the constant air stream to the jigging-material carrier and the material that is to be processed disposed thereon, a basic fluidization of the material disposed on the jigging-material carrier is achieved, so that therewith to a certain extent permanent loosening of the material is obtained that initially has a relatively low pressure loss as the working air flows vertically through the jigging-material carrier. Thus, with regard to the superimposed pulsating air stream, a relatively small volume flow of pulsed air is required in order within the framework of the process control immanent to an air jigging machine to periodically raise and lower the material bed disposed on the jigging-material carrier, and to thereby bring about the layering of the materials into a heavy material layer and a light material layer disposed thereon. The working air that flows through the jigging-material carrier is captured above the jig bed in a housing that encloses the jigging-material carrier, and is guided as exhaust air over a filter unit.

The known air jigging machine has the drawback of a limited capacity, since the surface of the jigging-material carrier cannot be arbitrarily increased.

A wet jigging machine having an increased capacity is described in DE-A-172 178. With this jigging machine, which is operated with a pulsating water flow, two jigging-material carriers are disposed over one another and through which flows the water that is located in a settling tank disposed below the lower jigging-material carrier, and that is caused to pulsate. Extending through the lower jigging-material carrier is a tubular member that is connected to the settling tank, so that the travel of the pulsating water can pass over the upper jigging-material carrier. The upper jigging-material carrier is furthermore also penetrated by a tubular member in order to be able to compensate for excess water buoyancy.

It is an object of the present invention to also design an air jigging machine having the aforementioned general features in such a way that its processing capacity is increased.

SUMMARY OF THE INVENTION

The basic concept of the present invention is that disposed over the air funnel, which is connected to an air supply conduit having inserted therein a pulsing valve, are at least two jigging-material carriers, which are disposed one above the other and are spaced apart, and through which successively flows an air flow that is introduced into the air funnel, with each of the jigging-material carriers having a material-feeding mechanism and a discharge device, whereby the intermediate space between the jigging-material carriers is enclosed by an outer wall, and wherein to increase the quantity of air that is supplied to the upper jigging-material carrier, at least one bypass line, which bypasses the lower jigging-material carrier, branches off from the air supply conduit downstream of the pulsing valve, and communicates with the intermediate space between the two jigging-material carriers in such a way that via the bypass line, an additional working air stream can be introduced into the intermediate space between the jigging-material carriers.

The present invention has the advantage that by means of the at least two jigging-material carriers that are disposed one above the other in the same air flow, approximately also twice the amount of material can be processed without having to alter the surface area or footprint design of the air jigging machine. If in contrast with a known air jigging machine the surface area of the single jigging-material carrier were increased in order to increase the throughput, on the one hand the requirement for the working air that has to flow through the larger surface area would increase correspondingly, but likewise the filter unit for the exhaust air must also have a correspondingly larger configuration, which is generally connected with higher costs. In contrast, pursuant to the present invention the energy that is still contained in the working air that is guided through the first, lower jigging-material carrier is utilized in order to flow through at least one second jigging-material carrier disposed there-above, whereby the working air that is to be guided through the intermediate space between the jigging-material carriers is channeled through the housing wall that encloses the intermediate space. To the extent that pursuant to the present invention for increasing the air quantity that is to be supplied to the upper jigging-material carrier at least one bypass line that bypasses the lower jigging-material carrier communicates with the intermediate space between the two jigging-material carriers, the leakage losses of separating air that occur in particular in the region of the feeding and discharge mechanisms are compensated for. The additional connection of the intermediate space to the air supply line downstream of the pulsing valve ensures that the supplemental air quantity supplied to the intermediate space has the same pulse pattern as does the working air that is supplied to the lower jigging-material carrier. Additionally, in so doing the throttle drops that occur at the outlets of the air supply conduit in the region of the air funnel are bypassed, thus making a greater amount of energy available in the supplemental air quantity that is introduced into the intermediate space.

In order to be able to better regulate the supplemental air quantity, a plurality of bypass air lines can also be provided. The present invention also encompasses the arrangement of more than two jigging-material carriers above one another. Since the inventive air jigging machine having at least two jigging-material carriers disposed one above the other is not significantly larger than air jigging machines having only a single jigging-material carrier, the inventive design of the air jigging machine results in a specific savings of investment costs with respect to the costs of the steel structure and the costs of the mechanical mechanisms.

It is to be understood that with the arrangement of at least two, but also a plurality, of jigging-material carriers in the same air flow one over the other, the pressure at the lowermost jigging-material carrier must be set higher by the pressure drops that additionally occur at the further jigging-material carriers, so that a higher-power working air blower must be provided. However, an additional blower power that might have to be provided is significantly less than is the case with a correspondingly adopted increase of the jig bed surface where there is only a single jigging-material carrier.

Since after passing the uppermost jigging-material carrier the air flow achieves the same state as in an air jigging machine having only a single jigging-material carrier, the size and the capacity of the following filter unit can be maintained, so that here no additional installations are required, which also represents an advantage for the present invention.

Pursuant to one exemplary embodiment of the invention, the bypass air line can be disposed externally on the housing of the air jigging machine, and can be connected to an air distributor that is mounted on the housing wall, whereby disposed on the housing wall are nozzle openings that connect the air distributor with the intermediate space between the jigging-material carriers.

Pursuant to one specific embodiment of the invention, a control valve can be inserted into the bypass line for regulating the quantity of air that flows through the bypass line.

With regard to an extensive possibility of application of the air jigging machine, discharge openings that can be regulated by means of a control device can also be disposed in the wall that encloses the intermediate space between the jigging-material carriers.

Pursuant to a first exemplary embodiment of the invention, respectively identical separating conditions are set at the upper jigging-material carrier and the lower jigging-material carrier; for this purpose, at the upper jigging-material carrier either the layer depth of the jigging-material layered on the upper jigging-material carrier can be adapted, or the separating surface of the upper jigging-material carrier can be appropriately altered, or both of the aforementioned parameters can be designed together and in conformity to one another, and in particular as a function of the pressure loss of the air flow connected with the flowing of air through the lower jigging-material carrier.

Alternatively, to establish different layer thicknesses of the heavy materials layered on the jigging-material carrier for the lower and the upper jigging-material carriers, a plurality of air lines and/or a plurality of discharge openings can be provided.

With regard to the supply of the working air, in a manner known from the aforementioned DE 20 2005 007 472 U1, the air funnel can be comprised of two chambers that are separated from one another and that in the direction of feed of the material over the jigging-material carriers are inserted successively, and a common air supply conduit can be guided into both chambers and is provided, in the region of each chamber, with at least one outlet for the working air that is supplied via the air supply conduit. To set the respective partial streams of working air that are introduced into the chambers, the cross-sectional areas of the air supply conduit outlets that are associated with the chambers of the air funnel can be adjustable.

For the supply of the working air, a pulsing valve for the common generation of a constant partial stream and a pulsating partial stream superimposed thereon can be inserted into the air supply conduit externally of the air funnel, whereby a central blower for the generation of the air stream that is to be conveyed into the air funnel can be connected to the air supply conduit.

Within the framework of such a configuration of the air funnel with two chambers, it can be expedient to also divide the intermediate space between the two jigging-material carriers into two chambers, in conformity with the configuration of the air funnel with chambers, by means of a separating flap that is disposed between the upper jigging-material carrier and the lower jigging-material carrier. Within the framework of such a configuration, it is to be understood that each of the chambers formed in the intermediate space can respectively be connected with the air supply conduit via its own bypass air line, or via a plurality of bypass air lines, or it can also be provided with its own discharge openings in the associated wall of the intermediate space. The separating conditions at the upper jigging-material carrier can also with this measure be maintained or set with respect to the separating conditions at the lower jigging-material carrier.

Pursuant to one specific embodiment of the invention, the separating result and the throughput of the air jigging machine are improved in that the jigging-material carriers are caused to vibrate by means of an associated drive, preferably by means of an oscillator or vibrator.

To the extent that each jigging-material carrier can have associated therewith its own material-feeding mechanism, for example in the form of a bucket wheel, pursuant to one specific embodiment of the invention a central material-feeding mechanism with the common provision of a respective material partial stream fed to the respective jigging-material carrier is provided for both jigging-material carriers. This results in a savings also with respect to the material-feeding mechanism.

The design of known air jigging machines having a single jigging-material carrier leads to a limitation of the separation result into two products, namely a light material, for example in the form of coal, and a heavy material, for example in the form of country rock or rock. A greater degree of purity of the light material can be achieved with a known air jigging machine only in that a certain amount of light material occurs in the heavy material, which, however, is a drawback with an air jigging machine that delivers two products.

With the inventive configuration of an air jigging machine of the aforementioned general type, it is for the first time possible with a single air jigging machine to also produce three or even more products since the heavy material layer that still contains an amount of light material is supplied from the upper jigging-material carrier as feed material to the lower jigging-material carrier, upon which then a separation of the light material still contained in the heavy material from the heavy material is effected. Since this process can be intensified by providing more than two jigging-material carriers, the production of more than three products with a single air jigging machine is possible with jigging-material carriers that are disposed in a cascade-like manner.

In detail, thus pursuant to one specific embodiment of the invention, the material-feeding mechanism for the material that is to be processed is associated with the upper jigging-material carrier, and the discharge device for the heavy material layered upon the upper jigging-material carrier communicates with the lower jigging-material carrier as a material-feeding mechanism for this lower jigging-material carrier.

To be able to fully utilize the natural direction of conveyance, the upper and the lower jigging-material carriers can be inclined relative to one another in opposite directions.

As already mentioned, pursuant to one exemplary embodiment of the invention a greater number of jigging-material carriers can be disposed one above the other.

BRIEF DESCRIPTION OF THE DRAWINGS

The drawing illustrates exemplary embodiments of the invention, which will be described subsequently. In the drawings.

DESCRIPTION OF SPECIFIC EMBODIMENTS

For a better understanding of the invention, initially the basic construction of the inventive air jigging machine is illustrated, and in particular without the additional bypass lines.

Figure 1:
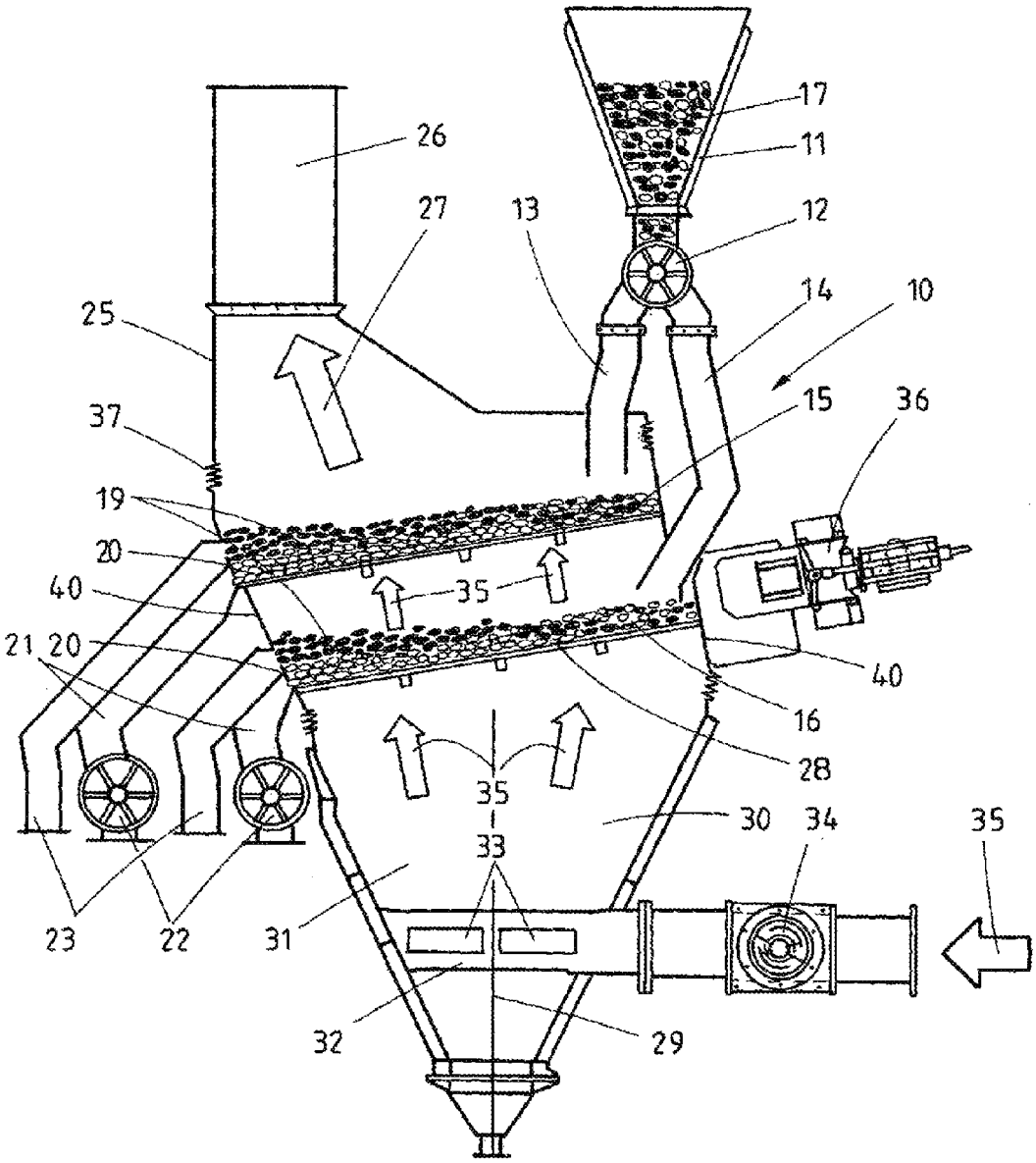
FIG. 1 is a schematic illustration of an air jigging machine having two jigging-material carriers disposed one above the other, with the additional bypass air line being omitted.

The air jigging machine 10 that is consequently shown in FIG. 1 has a feed hopper 11 that opens into a bucket wheel 12, which in a special manner is embodied such that the bucket wheel 12 distributes the material 17 that is to be separated or processed, and that is available in the feed hopper 11, to two feed chutes 13 and 14, each of which respectively ends at one end of two jigging-material carriers or supports 15 (upper jigging-material carrier) and 16 (lower jigging-material carrier), which are suitably arranged in the air jigging machine 10 one above the other and in a spaced-apart manner. As a consequence of the known movement kinematics of the air jigging machine, in the course of its transport over the length of the two jigging-material carriers 15, 16, the fed material 17, as jigging-material, is respectively layered into a heavy material layer 18, and into a light material layer 19 disposed there-above.

A respective dispensing or discharge device, in the form of a weir 20, is provided at the rear end of the two jigging-material carriers 15 and 16 opposite the respective feed chute 13 and 14. With each of the jigging-material carriers 15, 16, the weir separates the heavy material layer 18 from the light material 19 in such a way that the heavy material 18 is respectively conveyed into a first discharge chute 21, while the light material layer 19 passes over the weir 20 into the discharge chute 23 for the light material. To improve the ability to discharge, additionally provided in the two discharge chutes 21 that are respectively provided for the heavy material is a bucket wheel 22 for the removal of the heavy material.

The air jigging machine 10 is closed off toward the outside by means of a housing or casing 25 that extends beyond the upper jigging-material carrier 15, so that dust that possibly results during the dry processing or separation cannot pass into the atmosphere. The exhaust air flow 27 originating from the upper jigging-material carrier 15 is conveyed to an exhaust air unit 26 that is connected to the housing 25 and that includes a non-illustrated filter unit. Thus, pollution of the environment from such an air jigging machine is kept appropriately low.

Disposed below the lower jigging-material carrier 16 is an air funnel 28 via which the working air that is required for carrying out the separating movement is conveyed from below onto the lower jigging-material carrier 16, which is embodied as a perforated plate or a wire mesh. By means of a partition 29, the air funnel 28 is divided into two chambers 30, 31 that are separated from one another, with the first chamber 30 being adjacent to the feed chute 13 or 14, and with the second chamber 41 adjoining the first chamber 30 in the direction of conveyance of the material respectively guided by the jigging-material carriers 15, 16.

An air supply conduit 32 is guided into the air funnel 28; disposed in the air supply conduit are respective outlets 33 that are associated with each of the chambers 30, 31, so that the working air 35 that is guided via the air supply conduit 32 can flow into the chambers 30 and 31 respectively via the appropriate outlet 33. With regard to the generation of the settling movement, inserted into the air supply conduit 32 upstream of the air funnel 28 is a pulsing valve 34 by means of which not only the partial stream of working air that constantly flows through the jigging-material carriers 15, 16, but also the pulsing partial stream that is superimposed thereon, are generated.

In order to convey the working air that flows away or escapes from the upper side of the lower jigging-material carrier 16 to the upper jigging-material carrier 15, the intermediate space between the two jigging-material carriers 15, 16 is enclosed by an outer housing wall 40, which on the one hand is closed off in a suitable manner relative to the housing 25, and on the other hand is closed off in a suitable manner relative to the air funnel 28.

In the illustrated embodiment, the two jigging-material carriers 15 and 16 are additionally connected to an oscillator or vibrator 36 by means of which, to improve the material transport via the jigging-material carriers, these jigging-material carriers 15, 16 are moved relative to the stationary air funnel 28 and housing 25. For this purpose, the two jigging-material carriers 15, 16 are respectively isolated from the air funnel 28 and the housing 25 via seal members 37 that enable a relative movement between the jigging-material carriers 15 or 16, and the spatially stationary components of the air funnel 28 and the housing 25 respectively.

As can be seen in FIG. 1, the working air 35 that is guided in via the air supply conduit 32 is divided into two partial streams, one in each of the chambers 30 and 31, and hence initially flows through the lower jigging-material carrier 16. The working air exiting the lower jigging-material carrier 16 is guided by means of the intermediate space that is enclosed by the wall 40 to the upper jigging-material carrier 15 disposed above, and due to the energy still contained in the working area fulfills an appropriate function as separating air. After flowing through the upper jigging-material carrier 15, the working air, as the exhaust air flow 27, is supplied to the exhaust air unit 26.

It is easily recognizable that with such an arrangement of at least two jigging-material carriers 15 and 16, the capacity of the air jigging machine 10 can be increased without a considerable increase in the space required, as well as in the need for steel construction and machine components as would be the case with an air jigging machine according to the state of the art that has only a single jigging-material carrier. In this connection, the present invention is not limited to the use of two jigging-material carriers, but rather further additional jigging-material carriers can also be provided.

The embodiment illustrated in FIG. 2 corresponds with the air jigging machine described in conjunction with FIG. 1 with the exception that now the arrangement of the inventive bypass air lines 50 is illustrated, and that also in the intermediate space between the jigging-material carriers 15, 16 a division of the working air flows is undertaken in conformity with the chambers 30, 31 of the air funnel 28 disposed below the lower jigging-material carrier 16. In this connection, as air flows through the upper jigging-material carrier 15, the same conditions should exist for the working air guidance as is the case with the lower jigging-material carrier 16. For this purpose, disposed on the underside of the upper jigging-material carrier 15 is a freely suspended separating flap 41, the lower free end of which rests upon the light material layer 19 of the lower jigging-material carrier 16. The separating flap divides the intermediate space between the jigging-material carriers 15, 16 into chambers 30*a* and 31*a* that correspond to the chambers 30, 31 of the air funnel 28. Associated with the contact of the separating flap 41 is a sealing of the chambers 30*a*, 31*a* relative to one another. With a view toward different pressure conditions that might occur in the chambers 30*a*, 31*a*, the separating flap 41 is movably suspended about a shaft 42 that is guided through to the outside, whereby an arm 43 is mounted on the shaft 42 and carries an adjustable weight 44. The angular position of the arm 43 at the same time serves as an indicator for the thickness of the total material layer that rests upon the lower jigging-material carrier 16.

The bypass lines 50*a* and 50*b*, which are respectively connected to the two chambers 30*a* and 30*b* of the intermediate space that is disposed between the jigging-material carriers 15, 16, proceed from the central air supply conduit 32, and in particular from that portion thereof that is disposed between the pulsing valve 34 and the air funnel 28. This provides the advantage of bypassing the drops or losses that occur in the region of the chambers 30 and 31 of the air funnel 28 at the outlets 33 of the air supply conduit 32. Furthermore, the air flow into the two chambers 30, 31 is not the same; rather, a chamber-specific throttling has already taken place, perhaps due to the adjustable opening cross-sections of the outlets 33, so that also this individual or specific control due to the arrangement of the bypass lines 50*a* and 50*b* is taken into account externally of the chambers 30, 31. The two bypass lines 50*a* and 50*b* are guided upwardly externally on the housing on the air jigging machine in the region of the intermediate space between the jigging-material carriers 15, 16; the bypass lines open into a respective air distributor 51 mounted on the outside of the housing. By means of nozzle openings 52 formed in the housing wall 40, the two air distributors 51 communicate with the intermediate space between the jigging-material carriers 15, 16, so that the supplemental air quantities supplied via the bypass lines 50*a*, 50*b* can flow into the intermediate space via the air distributors 51 and the nozzle openings 52. The nozzle openings 52 preferably do not have the same-sized cross-sections, but rather are designed such that as uniform a distribution as possible of the supplemental air quantities is generated below the upper jigging-material carrier 15. Control valves 53 are additionally inserted into the lines 50*a* and 50*b*, so that the supplemental air quantities introduced into the chambers 30*a* and 30*b* can be respectively individually adjusted in order to be able to take into account possible differences in the separating condition on the lower and the upper jigging-material carriers. The supplemental air quantities that are introduced are intended to compensate for leakage losses of separating air, in particular in the region of the feed bucket wheel 12 as well as the discharge bucket wheels 22.

Alternatively, or in addition, discharge openings that can be regulated by means of a further control device can be disposed in the housing wall 40 that encloses the intermediate space between the jigging-material carriers 15, 16 in order to reduce the working air that flows to the upper jigging-material carrier 15 out of the air funnel 28.

Pursuant to the present invention, care is taken that at the upper jigging-material 15 and the lower jigging-material carrier 16 respectively the same separating conditions prevail, so that a uniform separating result can be achieved. However, different separating conditions can also be set at the upper jigging-material carrier 15 by means of an appropriate control of the supplemental air quantity introduced into the intermediate space via the additionally provided bypass lines 50*a*, 50*b*, or by means of the regulation of the discharge openings disposed in the housing wall 40.

Figure 2:
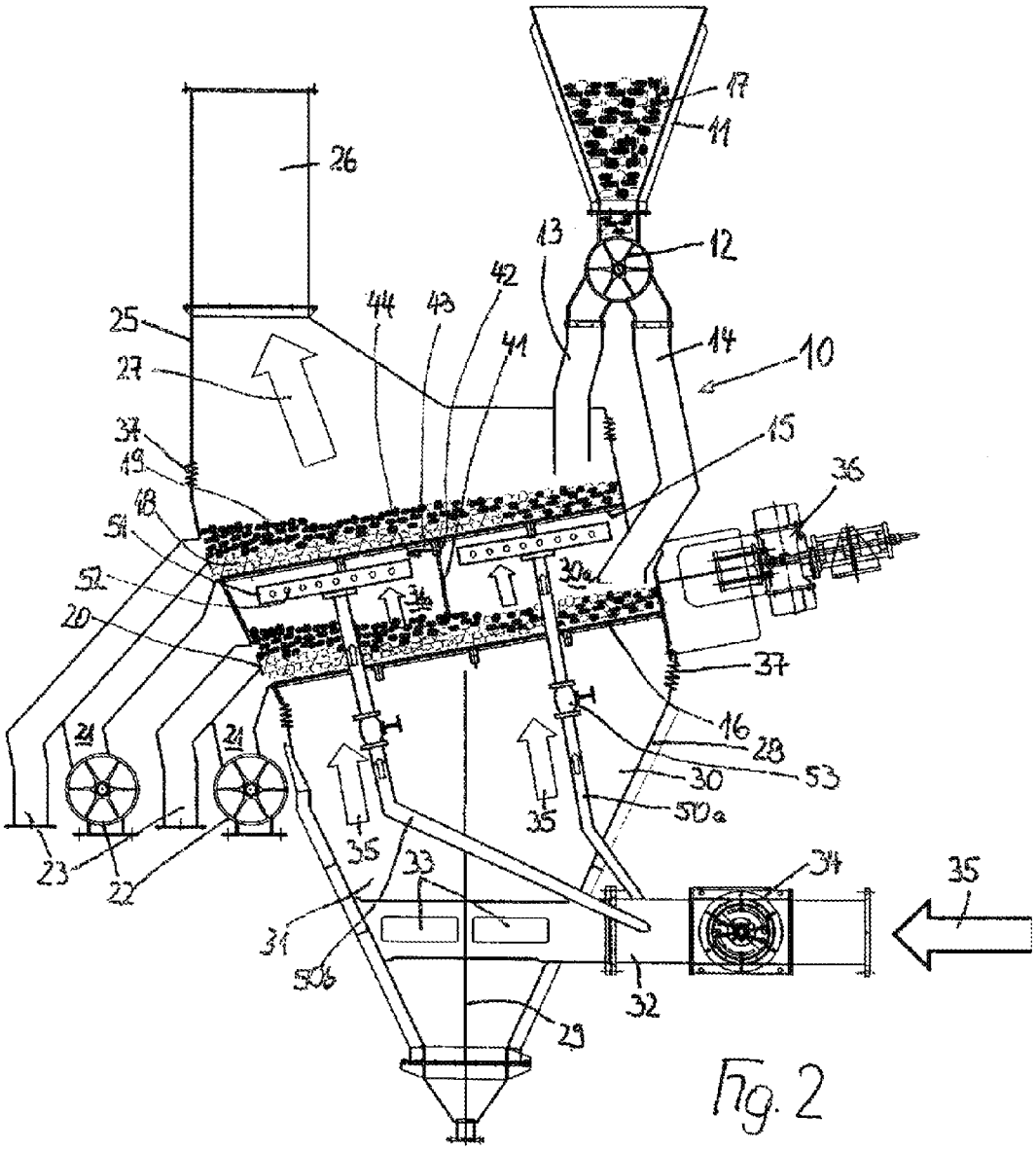
FIG. 2 shows the air jigging machine illustrated in FIG. 1 together with the bypass airline and also with a divided intermediate space between the jigging-material carriers.
Figure 3:
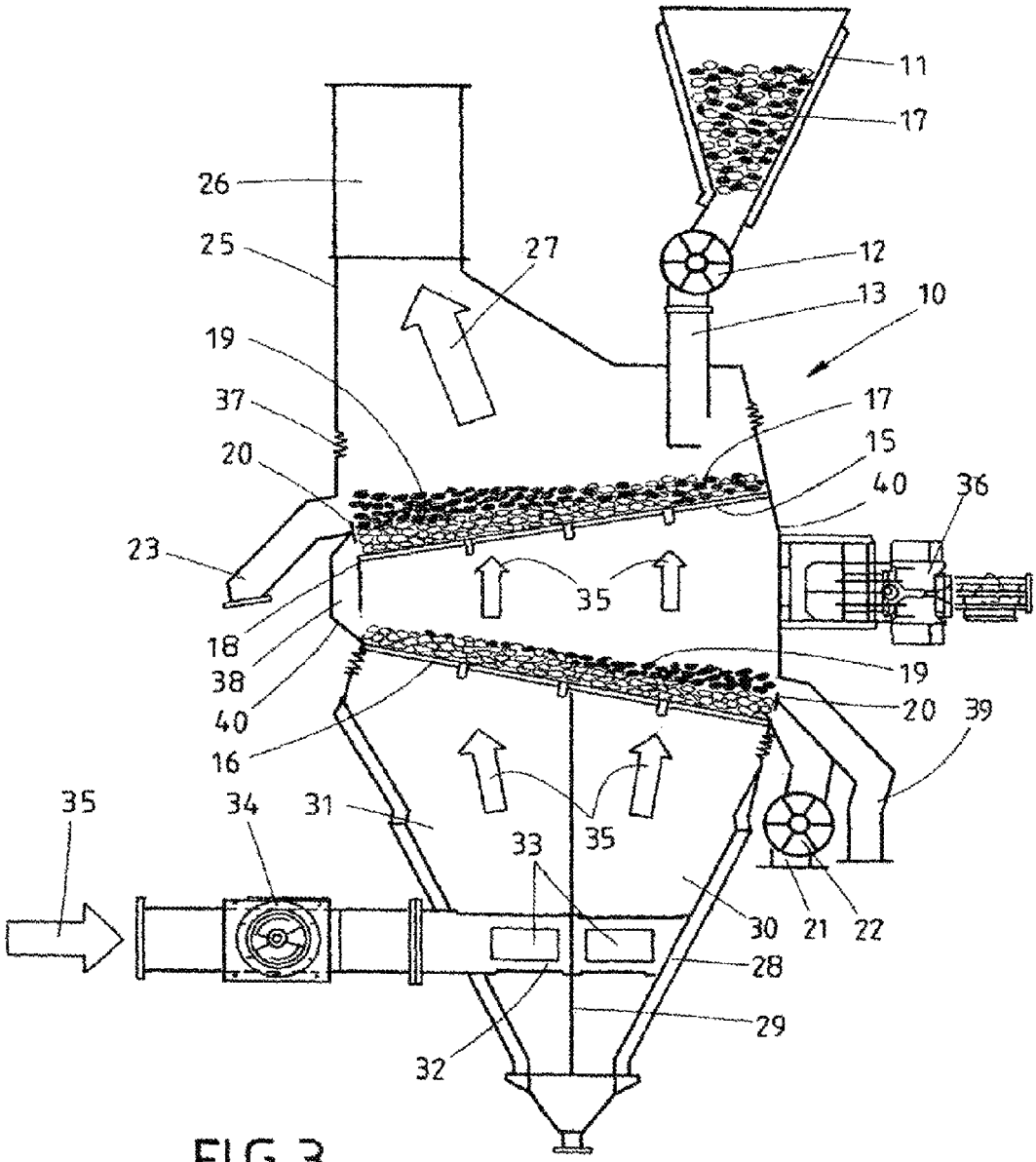
FIG. 3 illustrates another embodiment of the air jigging machine of FIG. 1, again omitting the bypass air line.

The embodiment illustrated in FIG. 3 differs from the embodiments illustrated in FIGS. 1 and 2 essentially in that the two jigging-material carriers 15 and 16 that are disposed one above the other do not serve for the increase of the total throughput of the air jigging machine 10 by means of a parallel connection, but rather that the two jigging-material carriers 15 and 16, with a view toward improving the separating result and the production of a further third product, are disposed one after the other, i.e. in series. For this purpose, the two jigging-material carriers 15 and 16 extend at opposite angles relative to one another, whereby the heavy material layer 18 produced on the upper jigging-material carrier 15 is supplied as a material discharge to the lower jigging-material carrier 16 by means of a discharge and feed device 38. In this connection, the separation conditions at the jigging-material carrier 15 are set such that a certain amount of light material can still be contained in the heavy material layer 18, as a result of which the separation success in heavy material and light material is improved at the upper jigging-material carrier 15. The heavy material layer 18 on the upper jigging-material carrier 15 that still contains amounts of light material is then subsequently conveyed over the lower jigging-material carrier 16, where once again a separation into a heavy material layer 18 and a light material layer 19 is effected, whereby this light material layer 19 of the lower jigging-material carrier 16 is discharged via a further light material chute 39; this light material can also be designated as secondary light material or middlings. Thus, the air jigging machine illustrated in FIG. 3 makes it possible to separate the material 17 that is to be processed into three products, namely a light material, an intermediate material and a heavy material.

The features of the subject matter of these documents disclosed in the preceding description, the patent claims, the abstract and the drawings can be important individually as well as in any desired combination with one another for realizing the various embodiments of the invention.

The specification incorporates by reference the disclosure of German 10 2010 015 232.3 filed Apr. 15, 2010, as well as International application PCT/EP2011/001898 filed Apr. 14, 2011.

The present invention is, of course, in no way restricted to the specific disclosure of the specification and drawings, but also encompasses any modifications within the scope of the appended claims.

The invention claimed is:

1. An air jigging machine (10) for dry processing of raw materials (17), comprising:

a material-feeding mechanism (11, 12);

an air funnel (28);

an air supply conduit (32) for supplying working air (35) to said air funnel (28), wherein a pulsing valve (34) is disposed in said air supply conduit (32);

at least two jigging-material carriers (15,16) for receiving material (17) from said material-feeding mechanism (11, 12), wherein said jigging-material carriers (15, 16)

are configured to consecutively receive therethrough working air (35) from said air funnel (28) and to separate the material (17) into heavy material (18) and light material (19) layers, and wherein said jigging-material carriers (15, 16) are disposed one above the other and are jigging from one another by an intermediate space;

a wall (40) for enclosing said intermediate space between said jigging-material carriers (15,16);

at least one bypass airline (50*a*, 50*b*) that branches off from said air supply conduit (32) downstream of said pulsing valve (34), bypasses a lower one (16) of said jigging-material carriers (15, 16), and communicates with said intermediate space for supplying an additional working air flow into said intermediate space between said jigging-material carriers (15, 16); and a respective discharge device (20) for each of said jigging-material carriers (15, 16) for said material (17) layered during a jigging process.

2. An air jigging machine according to claim 1, which further comprises an air distributor (51) mounted on said wall (40), wherein said at least one bypass line (50*a*, 50*b*) is disposed externally on a housing of said air jigging machine and is connected to said air distributor (51), and wherein nozzle openings (52) are disposed in said wall (40) and connect said air distributor (51) with said intermediate space between said jigging-material carriers (15, 16).

3. An air jigging machine according to claim 1, wherein a control valve (53) is inserted into said at least one bypass air line (50*a*, 50*b*) and is configured to regulate a quantity of air that flows through said at least one bypass air line (50*a*, 50*b*).

4. An air jigging machine according to claim 1, wherein regulatable discharge openings are disposed in said wall (40) that encloses said intermediate space between said jigging-material carriers (15, 16).

5. An air jigging machine according to claim 1, wherein for establishing respectively identical jigging conditions for said jigging-material carriers (15, 16) a layer thickness of the heavy material (18) layered upon an upper one (15) of said jigging-material carriers (15, 16), and/or a jigging surface of said upper jigging-material carrier (15), is adapted to a pressure loss of the air stream that is connected to a flow of air through said lower jigging-material carrier (16).

6. An air jigging machine according to claim 4, wherein for establishing different layer thicknesses of the jigging material layered on said jigging-material carriers (15, 16), a plurality of said bypass air lines (50*a*, 50*b*) and/or a plurality of said discharge openings are provided for said jigging-material carriers (15, 16).

7. An air jigging machine according to claim 1, wherein said air funnel (28) is comprised of two chambers (30, 31) that are jigging from one another and that in a direction of conveyance of said material (17) over said jigging-material carriers (15, 16), are disposed successively, and which includes a common air supply conduit (32) that is guided into both of said chambers (30, 31), wherein said air supply conduit (32) is provided with at least one respective outlet (33) in the region of each of said chambers (30, 31) for working air that is to be supplied via said air supply conduit.

8. An air jigging machine according to claim 7, wherein said outlets (33) of said air supply conduit (32) have variable cross-sectional areas.

9. An air jigging machine according to claim 7, wherein a central blower si connected to said air supply conduit (32) for producing an air stream that is to be introduced by said air supply conduit into said air funnel (28).

10. An air jigging machine according to claim 7, wherein in conformity with said chambers (30, 31) of said air funnel (28), said intermediate space between said jigging-material carriers (15, 16) is divided into two chambers (30*a*, 31*a*) by means of a jigging flap (41) that is disposed between an upper one of said jigging-material carriers (15) and said lower jigging-material carrier (16).

11. An air jigging machine according to claim 10, wherein each of said chambers (30*a*, 31*a*) of said intermediate space is respectively connected to a separate bypass air line (50*a*, 50*b*).

12. An air jigging machine according to claim 1, which includes a drive mechanism (36) for causing said jigging-material carriers (15, 16) to vibrate.

13. An air jigging machine according to claim 1, which includes a central material-feeding mechanism (11, 12) for said jigging-material carriers (15, 16), and wherein said material-feeding mechanism provides a respective partial material stream for each of said jigging-material carriers (15, 16).

14. An air jigging machine according to claim 1, wherein said material-feeding mechanism (11, 12) is associated with an upper one of said jigging-material carriers (15) for supplying said material (17) that is to be processed thereto, and wherein said discharge device (20) for said heavy material (18) layered on said upper jigging-material carrier (15) is connected to said lower jigging-material carrier (16) as a material-feeding device (38) for said lower jigging-material carrier (16).

15. An air jigging machine according to claim 14, wherein said upper and lower jigging-material carriers (15, 16) are disposed at angles relative to one another that extend in opposite directions.

16. An air jigging machine according to claim 1, wherein three or more jigging-material carriers are disposed one above the other.

* * * * *